United States Patent [19]

Waniek et al.

[11] Patent Number: 4,513,046

[45] Date of Patent: Apr. 23, 1985

[54] ANTISTATIC SUPPORT

[75] Inventors: Kurt Waniek, Purkersdorf; Heinz Tichy, Vienna, both of Austria

[73] Assignee: Semperit Aktiengesellschaft, Traiskirchen, Austria

[21] Appl. No.: 406,238

[22] PCT Filed: Dec. 18, 1981

[86] PCT No.: PCT/AT81/00032

§ 371 Date: Aug. 2, 1982

§ 102(e) Date: Aug. 2, 1982

[87] PCT Pub. No.: WO82/02315

PCT Pub. Date: Jul. 8, 1982

[30] Foreign Application Priority Data

Dec. 22, 1980 [AT] Austria ..... 6240/80

[51] Int. Cl.[3] ..... B25H 3/06; B25H 1/10

[52] U.S. Cl. ..... 428/156; 428/163; 428/167; 248/633

[58] Field of Search ..... 428/156, 163, 167; 581/4; 248/633

[56] References Cited

U.S. PATENT DOCUMENTS

| | | | |
|---|---|---|---|
| Re. 20,924 | 11/1938 | Nickle | 4/581 X |
| D. 85,859 | 12/1931 | Capouch | 4/581 X |
| 2,032,935 | 3/1936 | Hurt | 428/156 X |
| 2,449,465 | 9/1948 | Flaker | 4/581 X |
| 3,922,409 | 11/1975 | Stark | 428/156 X |
| 4,139,138 | 2/1979 | Besselman, Jr. | 269/16 X |
| 4,281,038 | 7/1981 | Ambros et al. | 428/156 X |

FOREIGN PATENT DOCUMENTS

| | | | |
|---|---|---|---|
| 150118 | 8/1934 | Austria | 428/156 |
| 1530494 | 2/1969 | Fed. Rep. of Germany | 428/156 |
| 2057923 | 5/1971 | France . | |
| 2201609 | 4/1974 | France . | |
| 2328431 | 5/1977 | France . | |
| 427914 | 5/1935 | United Kingdom | 428/156 |
| 619168 | 3/1949 | United Kingdom | 248/633 |
| 717397 | 10/1954 | United Kingdom | 428/156 |

OTHER PUBLICATIONS

Advertisement published in the Journal "Elektronik", vol. 3, 1978, p. 7.

*Primary Examiner*—George F. Lesmes
*Assistant Examiner*—Nancy A. B. Swisher
*Attorney, Agent, or Firm*—Werner W. Kleeman

[57] ABSTRACT

The antistatic desk pad for a working station in the electronic field is comprised of a rubber sheet with a resistance of at least $10^2\Omega$ cm. The upper portion of the sheet is provided with cavities of which the length is at least 8 mm, those cavities being intended to receive the debris of wires or the like.

11 Claims, 4 Drawing Figures

ANTISTATIC SUPPORT

Figure 1:
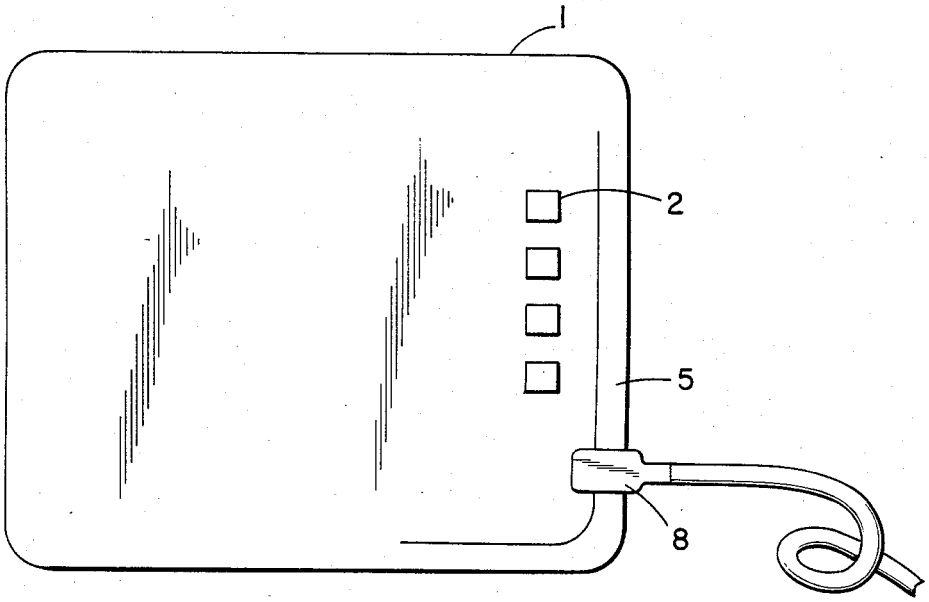

The present invention relates to an antistatic support for work places serving for the manipulation of electronic components and composed of a rubber layer having a specific volume resistance (according to DIN 53482) of at least $10^2$ Ωcm.

The damage to electronic components by the effects of electrostatic charges constitutes a problem which increases with the sensitivity of such components. Of particular significance is the high capacitance constituted by a human being. Values up to 4,000 pF have already been measured and the mean value is in the order of about 200 pF. Due to rubbing against articles of clothing, the floor, seating surfaces and the like the body is electrostatically charged up to peak voltages of 6,000 volts. The discharge of such voltages across an electronic component can lead to its destruction, and the damage need not be immediately noticeable, rather can be present in terms of appreciably impairing the service life.

Particularly endangered electronic components are, for instance, so-called CMOS switching circuits, because their insulated control electrode (gate) possesses a high impedance and capacitively influences the flow of current. Such type of switching circuits possess an extremely thin dielectric film which is suitable for taking-up an undesired charging state, whereby then, if there is exceeded a critical threshhold, there occurs a breakdown through the dielectric to ground potential. Also a great many other electronic components are highly sensitive to antistatic charges.

In order to counteract such problem there are used simultaneously at the present time three measures:

1. The work rooms are furnished with ionized air, so that in this way there can be accomplished a neutralization of electrical charges,
2. The relevant operator is grounded by means of a conductive band through a protective resistance, and finally there is ensured
3. That all work is accomplished at supports which ensure for a rapid removal of electrostatic charges.

As an additional safety factor there are also used floor covering mats which cause grounding of all persons who come into the vicinity of the work place.

The known antistatic supports possess a multi-layer construction, and the top layer consists of a mass of ground conductive plastic material. Located therebelow is a highly conductive intermediate layer, for instance in the form of a mesh composed of carbon fibers. Below such there is finally located a foamed plastic layer for increased comfort and an underside composed of a material resistent to sliding.

This known support can attain the desired effect of removing antistatic charges, but it is however relatively uneconomical by virtue of its complicated construction. Additionally, the temperature resistance of the plastic material used in the top layer is not sufficient in order to avoid damage to such layer, for instance during unintentional contact with a soldering iron. In fact, there exists the danger that upon burning through the top layer the highly conductive intermediate layer will be exposed, which can lead not only to undesired short-circuits of the manipulated components, but even constitutes a certain danger in the event there come into contact therewith bare conductor parts.

There have also already become known supports formed of antistatic rubber material. These supports likewise possess, just as was the case for the above-mentioned multi-layer supports, an essentially smooth, if desired, slightly structured top surface. During the course of the work which is performed at such type of support, for instance the fabrication of electronic circuits, such support becomes contaminated by wire pieces, solder material and waste, and hence, hinders a rapid and clean work.

Therefore, the present invention has for its object the provision of an antistatic support which from the standpoint of electrical safety is 100% satisfactory, affords a positive withdrawal of electrical charges from antistatically charged bodies, is resistant against sliding, and always presents a clean work surface even over longer periods of use.

This is achieved according to the invention with an antistatic support of the previously mentioned type in that, at least a part of the top surface of the support possesses preferably uniformly distributed recesses, the extent or dimension of which, in plan view, as measured in at least one direction amounts to at least 8 mm, preferably at least 10 mm.

This construction of an antistatic support satisfies in all aspects the above explained objectives. In particular, it is thus possible to achieve the result that wire pieces and the like drop into the recesses and no longer are disturbingly present at the actual work surface. Due to this construction of the surface of the antistatic support there is obtained, by virtue of the surface structuring by means of the recesses, a good contact possibility to parts placed thereon. Electronic components are frequently also packaged in conductive bags which likewise during the transport electrostatically charge upon the work surface. Therefore, measures must be taken to ensure that such charge is withdrawn upon deposition of the bags upon the support. This can be particularly rapidly accomplished with a support according to the invention, since the transfer resistance, for instance from the support to the bags, is maintained small.

Of course, the antistatic support is grounded, since otherwise there could not be accomplished an outflow of the charges. Frequently there is provided at the wall bounding the workplace or at the floor a grounding rail at which there can be electrically conductively connected the supports at the work place and, if desired, at the floor. To ensure that the operating personnel itself likewise possesses as small as possible charge, there are used conductive hand bands which are conductively connected by means of a suitable connection, for instance a push button or a Dutch tong with the support located at the work place.

Regarding the dimensions of the inventive recesses, it is necessary to start with the fact that the wire pieces which are produced as waste during the work possess a maximum length of about 8 mm., so that in any event they have place within the recess. The recesses should be distributed at least over the part of the top surface which is used for performing the work, and the spaces between the recesses should not be too great.

An appreciable safety advantage of the inventive antistatic support formed of rubber can be realized in that, in contrast to the known plastic supports, it is also equipped to be outstandingly protected against fires. By the addition of suitable fire protection agents to the rubber and the selection of suitable rubber compositions it is possible to extensively minimize the danger of fires.

It is therefore possible to eliminate the danger of fires owing to negligent handling of the soldering iron.

Advantageously, the depth of the recesses can amount to 2 to 5 mm, preferably 3 to 4 mm. This depth of the recesses ensures that the waste-wire pieces will come to lie within the recesses, and even an inclined position of such wire pieces still will not cause any protruding out thereof from the recesses and thus into the working region. What is also advantageous with such dimensioning of the recesses is that the recesses can be used during the work for fixing certain components, so that there can be effectively prevented any unintentional brushing away thereof due to movements of the hand of the operator.

In order to avoid that the aforementioned wire pieces come to lie at the webs between the recesses, it is advantageous if the web width of the material between the recesses amounts to 1 to 5 mm. Due to the average length of the wire pieces, as a general rule, there results a tilting of such wire pieces into the recesses, so that the desired effect of maintaining free the actual work surface from contaminants can be obtained.

There is also then favored the above-discussed dropping-in of the wire pieces if the recesses widen outwardly in a trough-like fashion. Consequently, the walls of the recesses are somewhat inclined and render possible a rolling and sliding action. This construction is also advantageous for the cleaning of the support, since as a result there are not formed any corners and angles from which contaminants would be difficult to remove.

An embodiment of the invention contemplates that the recesses, in plan view, are constructed to be parallelogram-like in configuration. The major axis of the parallelogram can then be oriented approximately parallel to the work place edge which confronts the operator, so that as a general rule the wire pieces can drop in this direction of the recesses. The parallelograms are arranged with their shorter axes away from the operator, so that there is formed a somewhat compacter surface in this direction.

A further advantageous construction of the invention contemplates that the recesses, in plan view, possess a preferably triangular rondular profile. Rondular profiles are characterized by the fact that their chords leading to the center, just as is the case for circles with regard to their diameter, all have the same length. Thus, it is of no importance in the case of a rondular cross-section in which direction the wire pieces drop down: in any event they drop in the correct orientation into the recess.

As already above-discussed the antistatic support is connected, if desired, by means of Dutch tongs with a grounding rail. An advantageous mounting of the Dutch tong is then possible if the support possesses a thickened portion at least at one side along the edge. The Dutch tong then can be clamped over this thickened portion. However, the thickened portion also acts as a barrier against the dropping-off of components from the support, which likewise constitutes a desired effect. An analogous effect is also then realizable if the support possesses a groove at least at one side along the edge. This groove likewise serves for catching components which otherwise could be wiped-off of the support.

In many instances it is advantageous if the support only possesses recesses at its top surface, whereas the bottom surface is essentially smooth and, at most, possesses a design which improves its resistance to sliding. In the case of such type of construction of a support, it is possible, when performing working manipulations where such characteristic is possibly desirable, to reverse the support, so that its essentially smooth lower surface becomes the top surface.

In order to render possible use of the support at both sides in the sense of the present invention it is however advantageous if the top surface and bottom surface of the support possess recesses.

According to an advantageous construction of an antistatic support according to the present invention such possesses a surface resistance, measured in accordance with DIN 53596, of at most 10 Ωcm. Due to this resistance characteristic there is ensured that there prevails over the entire surface of the support always an essentially equal potential, which also holds true for the electronic components which are deposited at different locations of the antistatic support.

In the description to follow there will be more fully explained by way of example the invention based upon the drawings.

Figure 2:
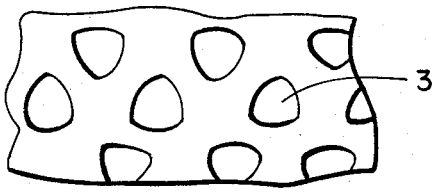

FIG. 1 illustrates a top plan view of a support,

FIG. 2 a fragmentary view of a top plan view, and

Figure 3:
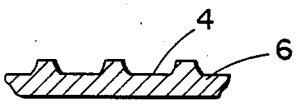
Figure 4:
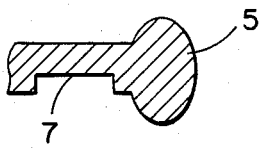

FIGS. 3 and 4 are cross-sectional views through partial regions.

In FIG. 1 there is illustrated a support 1 which in plan view essentially possesses square recesses 2. Along the edge the support 1 possesses a thickened portion 5 over which there can be placed at a suitable location a Dutch tong 8 which brings about the conductive connection to a ground conductor.

The recesses of the support 1 can possess in plan view any other desired geometric shape. In FIG. 2 there is illustrated a section of a support 1, and the recesses 3 possess in plan view the shape of a tri-rondular configuration. As above-explained due to this construction there is attained the result that it is immaterial in which direction dropping wire pieces fall into the recesses, since such possesses the same diameter in all directions.

FIG. 3 illustrates a partial region of a support 1 in cross-section. There will be recognized that the recesses 4 are separated by webs 6. The walls of the webs 6 drop in a concave curved fashion towards the base of the recess 4, so that there is favored a sliding-in of wire pieces. The inclining of the walls of the web 6 can also be flatter and is dependent upon the special requirements of the relevant work place.

In FIG. 4 there is shown a portion of a marginal region, in cross-section, of a support 1. There will be recognized the thickened edge portion 5 which in cross-section is approximately eliptical. At the underside of the support 1 there is located, adjacent the thickened portion 5, an encircling groove 7 which then has ascribed thereto increased significance if the support 1 is used in a reversed position. The thickened portion 5, among other things, serves for the connection of a Dutch tong for the ground conductor and for the conductive arm band.

What we claim is:

1. An antistatic grounded support for work places serving for the manipulation of electronic components, said antistatic support comprising:

a rubber layer having a specific volume resistance (according to DIN 53482) of at least $10^2$ Ωcm, a sufficiently low surface resistance for conducting away any static charges which may accumulate thereon, and defining two surfaces;

at least a portion of one of said two surfaces of said rubber layer is provided with recesses having a bottom and serving for the reception of waste materials;

said one of said two surfaces of the rubber layer constituting the top surface thereof which is used for performing work thereupon; and each said recess having, in top plan view, a dimension of at least 8 mm in at least one direction;

said recesses each have a depth in the range of 2 to 5 mm;

webs formed between said recesses; and each said web having a width of material between the recesses in the range of 1 to 5 mm.

2. The antistatic support as defined in claim 1, wherein:

each said recess widens in a trough-like fashion from said bottom towards the outside.

3. The antistatic support as defined in claim 1, wherein:

each said recess, in top plan view, possesses a parallelogram-like configuration.

4. The antistatic support as defined in claim 1, wherein:

each said recess, in top plan view, possesses a tri-rondular configuration.

5. The antistatic support as defined in claim 1, further including:

a thickened portion formed at least at one side along an edge of said rubber layer.

6. The antistatic support as defined in claim 1, further including:

a groove formed at least at one side along an edge of said rubber layer.

7. The antistatic support as defined in claim 1, wherein:

both said two surfaces of said rubber layer possess recesses.

8. The antistatic support as defined in claim 1, wherein:

said rubber layer possesses a maximum surface resistance, measured according to DIN 53496, of 10Ω.

9. The antistatic support as defined in claim 1, wherein:

said recesses are essentially uniformly distributed at said portion of said one surface of said rubber layer.

10. The antistatic support as defined in claim 1, wherein:

said recesses having a dimension of at least 10 mm in said at least one direction.

11. The antistatic support as defined in claim 2, wherein:

said recesses have a depth in the range of 3 to 4 mm.

* * * * *